United States Patent [19]

Anjou

[11] 4,364,488

[45] Dec. 21, 1982

[54] CHILD-PROOF CONTAINER

[76] Inventor: Gunnar Anjou, Saltholmsgatan 43, Västra Frölunda, Sweden, 421 76

[21] Appl. No.: 194,346

[22] Filed: Oct. 6, 1980

[30] Foreign Application Priority Data

Oct. 19, 1979 [SE] Sweden ..... 7908671

[51] Int. Cl.[3] ..... A45C 13/10

[52] U.S. Cl. ..... 220/281; 220/347; 206/1.5

[58] Field of Search ..... 220/347, 281, 346, 345, 220/351; 206/1.5, 528

[56] References Cited

U.S. PATENT DOCUMENTS

| | | | |
|---|---|---|---|
| 3,888,350 | 6/1975 | Horvath | 220/347 |
| 4,076,117 | 2/1978 | Wisdom et al. | 220/347 |
| 4,174,034 | 11/1979 | Hoo | 220/347 |

*Primary Examiner*—Joseph Man-Fu Moy

*Attorney, Agent, or Firm*—Holman & Stern

[57] ABSTRACT

A child-proof container (1) comprising a box (2) and a casing (3), in which the box is insertable, whereby the opening of the box is prevented by means of catch members (4), which in unloaded condition project a small distance into the box from the inner side of one of the flat side surfaces (3*a*) of the casing, whereby said side of the casing is flexible under influence of side forces (A) acting against each other for raising the catch members above the box (2). (FIG. 1).

9 Claims, 16 Drawing Figures

CHILD-PROOF CONTAINER

BACKGROUND OF THE INVENTION

1. Field of the Invention

The present invention relates to a child-proof container of the type comprising a box, which is displaceable in a casing, open at both ends and having at least one of its flat side walls made from a material which is somewhat flexible in the latitudinal direction and where the casing on the inside of its said one flat side wall is provided with catch members projecting towards the interior of the casing.

Items having great material value are yearly destroyed due to children playing with matches and accidental deaths also sometimes happen which are directly or indirectly caused thereby.

2. Description of the Prior Art

In order to minimize this risk there have been proposed different methods for making the opening of match boxes more difficult, whereby at least small children are hopefully prevented from opening the container and reaching the matches. In a corresponding manner it can also be desirable to prevent small children from opening containers for medicaments or other goods with which children can cause injury to themselves or the environment.

These previous proposals for child-proof boxes however have been so complicated that the box has been unreasonably expensive to manufacture, or the opening function has been so complex that adults have had difficulties in opening the box and at least have had to use both hands for doing it. Finally the earlier child-proof boxes for matches has, like conventional match boxes, been designed with a friction surface on one or more of the outer sides of the casing, whereby a child who finds a loose, unused match and a child-proof box can still cause fires even if the box cannot be opened.

In one type of match container it has been proposed in order to prevent the box from unintentionally sliding out of the casing to provide the inner side of the upper side of the casing with a thin material strip, which engages the inner edge of the box, but this material strip has been so thin that its arresting ability has been overcome merely by pushing the box a little harder in its normal opening direction and this container has therefore not been child-proof.

BRIEF SUMMARY OF THE INVENTION

The purpose of the invention is to provide a child-proof container of the type defined hereabove, which is just slightly more expensive to manufacture than a conventional container, eliminates the above mentioned drawbacks of previous child-proof containers and provides a container which for adults is easy and functional to operate whereas children, especially if they cannot read, cannot open the container without particular instructions. This has been achievedby the invention by providing that the catch members of the casing consist of at least two, spaced apart members located one near each one of the open ends of the casing and extend towards the interior thereof a distance considerably exceeding the normal play between casing and box, and which catch members are adapted, when the container is closed and not under the influence of outside forces, to extend well inside the edge of the container's short side walls, thereby preventing unintended and unauthorized opening of the container, and during an outward bending of the said one flat side wall of the casing caused by outer forces acting perpendicularly against the displacement direction of the box, to be displaced so that it will allow free displacement of the box past said catch members.

With this design it is required for the opening of the container that two different movements are made simultaneously, in different directions, i.e. it is necessary to press against the upper edge of the longitudinal sides of the casing and simultaneously to push at the end side of the box and this is particularly difficult for small children as their motoric cooperation is not yet sufficiently trained to make complex composite movement patterns.

DESCRIPTION OF THE DRAWING

The invention will hereinafter be further described with reference to the embodiments shown in the accompanying drawings wherein.

DETAILED DESCRIPTION

Figure 1:
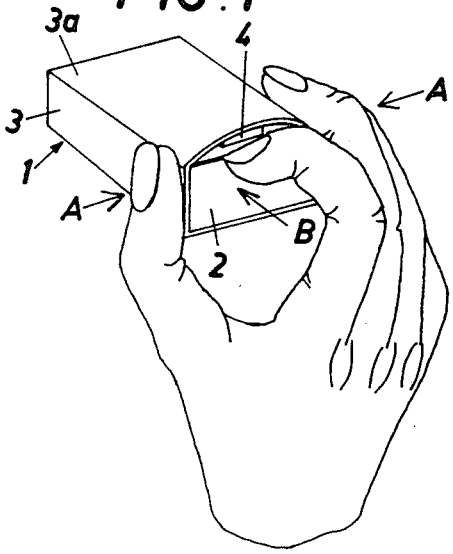
FIG. 1 is a perspective view showing the opening of a child-proof container according to the invention.

In FIG. 1 is shown in a perspective view the manner for opening a child-proof container 1 in accordance with the invention and which container incorporates a box 2 of common appearance and shape which is displaceable in a casing 3 which is open at both ends and which is made with at least its upper side wall of a material which is temporarily somewhat flexible, at least in the latitudinal direction of the container, i.e. the side which in use covers the open side of the box. Such a flexibility is for instance achieved with a casing where at least the upper side is made of a rigid cardboard. From manufacturing as well as cost aspects the entire casing is however preferably made of the same material.

The inner side of the upper side wall 3*a* of the casing is provided with catch members 4 which project inwards, and which members in the example shown consist of cams 4 attached to the inner side of the casing wall. By pushing against the upper edges of the longitudinal sides of the container, e.g. with the thumb and the long finger in a direction inwards-upwards—in the direction of arrows A—it is thereby possible to bring about such a temporarily bending of the upper side of the casing at the end of the casing from which the container shall be opened, that it is possible to move the side edge of the box below the cam 4 and thereby to open the container e.g. by pushing on the short end wall of the box with the index finger in the direction of arrow B.

Figure 2:
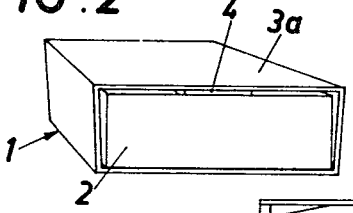
FIG. 2 is a perspective view of a container according to the invention in closed position.
Figure 3:
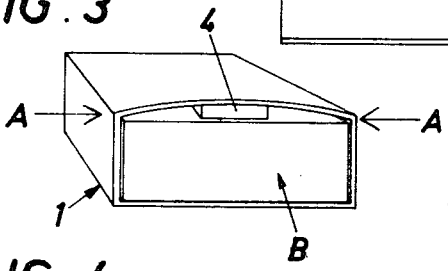
FIG. 3 shows in a corresponding perspective view the temporary deformation of the upper side of the container necessary for its opening.
Figure 4:
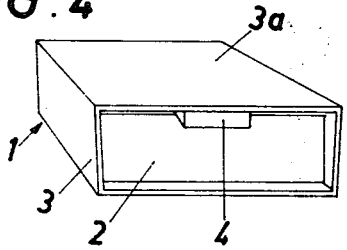
FIG. 4 shows in a corresponding perspective view the container according to FIGS. 2–3 in open position.

FIGS. 2–4 show in perspective the container 1 in a neutral position during the opening stage and in the position where the box 2 has been moved past the cam 4 and thereby can be further opened without prevention by this cam.

As can be seen from FIG. 2 the casing 3 may preferably be provided with side walls which diverge somewhat in a direction from the bottom to the upper side 3*a*. Thereby the wedging of the box 2, which will otherwise easily appear at the compression of the casing shown in FIG. 3, is completely eliminated and the box will not "pinch" during its displacement.

In FIGS. 5–8 are shown schematical, longitudinal sections through the container according to FIGS. 1–4 in a completely closed position, during the very opening stage, during further opening and in a maximum opened position respectively.

As can be seen from these views the projecting catch members 4 in this embodiment are as mentioned above formed as cams, which preferably are located one near each other of the open short ends of the casing and as can be seen from FIGS. 2–4 each cam is located in the middle of the associated short side of the casing and it extends over a smaller part of the length of the short-side, whereby the necessary bending of the upper side of the casing is limited.

Figure 5:
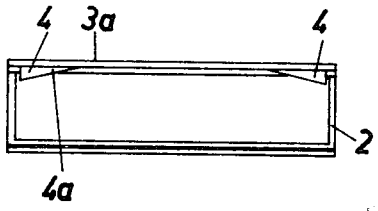
FIGS. 5–8 show in schematical, longitudinal cross sectional views through the container according to FIGS. 1–4 different stages from the closed position of the container to its maximum opened position.
Figure 6:
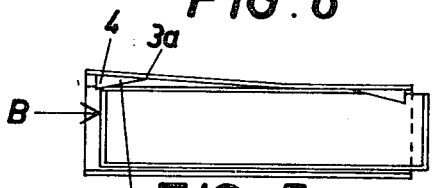
Figure 7:
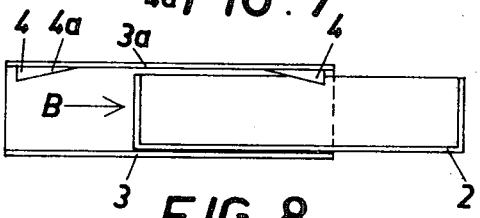
Figure 8:
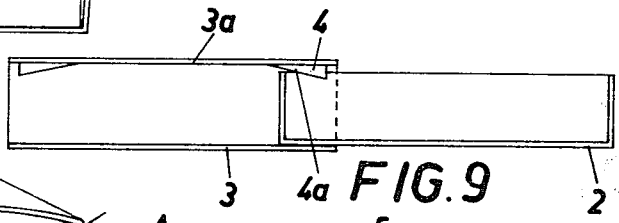

As can also be seen from FIGS. 5 and 6 the size of each cam 4 is such that it, when the casing 3 is not acted upon by any forces along the arrows A, will extend somewhat below the short side walls of the box and thereby prevent its opening, whereas when the casing is compressed with the forces in accordance with FIGS. 1 and 3 such as shown in FIG. 6 the cam 4 at the side of the compression will rise above the upper short end wall of the box, whereby the box can be displaced with a force in the direction of arrow B. In FIG. 7 is shown the continued displacement of the box 2, whereby the forces A need not longer act upon the casing 3, and in FIG. 8 is shown how the cam 4 at the opposite end of the casing will prevent the box 2 from being pushed entirely out of the casing. This is a particular advantage, when the box 2 after a plurality of bendings and small temporary deformations of the casing, can begin to slide so easily in the casing that it otherwise could fall out of the casing unintentionally when the container is opened.

In order to make possible that the box when so desired can be easily pulled entirely out of the casing and that it can again easily be closed entirely after use, the cams 4 are designed as ramps which are inclined in a direction away from the associated end of the casing, which ramps form sliding surfaces 4*a*, which will facilitate the closing and the pulling out of the box from the casing.

Figure 9:
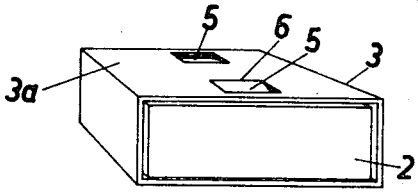
FIGS. 9 and 10 are perspective views showing a modified embodiment of a container for matches according to the invention in closed and open positions respectively.

In FIG. 9 is shown in a perspective view a modified embodiment of a match container according to the invention in closed position. The container incorporates like the preceding embodiment according to FIGS. 1–8 a casing 3 with a box 2 displaceable therein, but the catch members arranged on the inner side of the upper wall 3*a* of the casing which project against the interior of the casing are in this case formed as tabs 5 integral with the material of the casing, which tabs have been punched out or in any other suitable manner been formed out of the upper wall 3*a* of the casing, whereby each tab 5 is connected to the wall 3*a* of the casing via a bending line 6, whereas the remainder of the tab extends against the associated open end of the casing and is bent permanently downwards-inwards against the interior of the casing. The size, location shape and function of the tabs correspond otherwise to that of the cams according to FIGS. 1–8. It may be desirable that the tabs in this embodiment are made more rigid in an appropriate way, e.g. by plastic coating.

Figure 10:
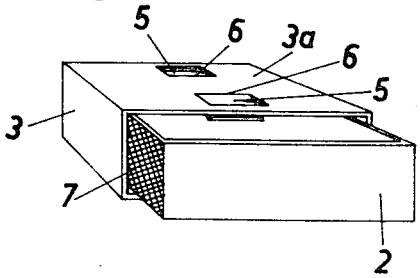

In FIG. 10 the match container according to FIG. 9 is shown in opened condition and as can be seen the friction surface 7 of the match container is arranged on the outer side of the box in contrast to its common location at the outer side of the casing. Thereby the risk that small children who find an unused match can light it, unless the match container is opened, is avoided. It is of course also possible to apply the friction surface to the inner side of the casing or to the bottom of the box, whereby it cannot be reached without the container being opened first.

Figure 11:
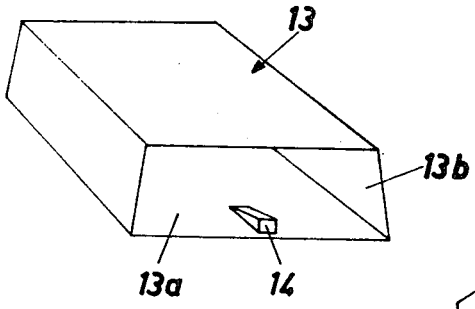
FIG. 11 shows in perspective a casing for a child-proof container according to another embodiment of the invention in an alternative position of use.
Figure 12:
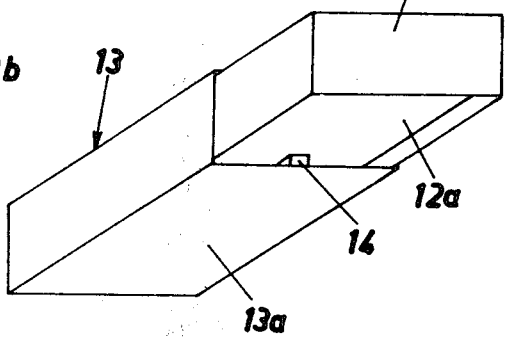
FIG. 12 is a perspective view of the casing according to FIG. 11 with a box of modified design partly inserted therein.

FIGS. 11–16 show two further embodiments of a child-proof container according to the invention, which embodiments use a casing 13, which is identical with the casing 3 used in the embodiments according to FIGS. 1–10, except that the casing 13, as can be seen from FIGS. 11 and 12, is used in an upsidedown position as compared to the earlier embodiments. The cams 14 are also made the same as the cams 4, or the tabs 5, and the side walls 13*b* of the casing are also inclined toward each other as seen from the wall surface 13*a* provided with the catch members 14.

Figure 13:
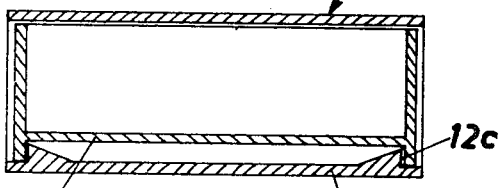
FIG. 13 shows a longitudinal cross-sectional view through the container according to FIG. 12 in completely closed position.

FIG. 11 shows this casing 13 in perspective and it is furthermore shown in perspective in FIG. 12 with a box 12 partly inserted therein. This box 12 differs from the common box 2 in that its bottom 12*a* is retracted a distance above the lower edges of at least the short end walls of the box. In FIG. 13 is shown in a cross-section through the completely closed container according to FIG. 12, how the cams 14 will come to engagement against the portions 12*c* of the short end walls of the box 12 situated below the box bottom 12*a* and thereby lock the box in closed position in the casing. This embodiment gives in comparison with the hereabove described embodiments, the advantage that the catch members do not extend down into the interior of the box. It is hereby possible to provide the box with an air and/or liquid-tight covering foil 15, which is desirable for different types of medicaments and the like.

Figure 14:
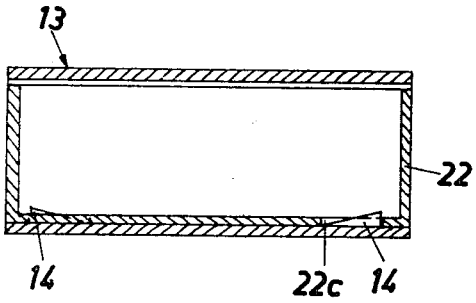
FIG. 14 shows a longitudinal cross-sectional view through a further modified embodiment of a child-proof container according to the invention.
Figure 15:
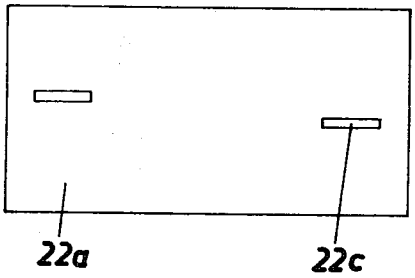
FIG. 15 shows in a schematic planar view the bottom of the box of the container as shown in FIG. 14.

In FIG. 14 is shown in a cross-section corresponding to FIG. 13 a further modified version of a child-proof container according to the invention. The casing 13 may be identical with that used in the embodiment according to FIGS. 12 and 13, whereas the box is designed as a common box 22 having its bottom 22*a*, as shown in FIG. 15 in a planar view, provided with two recesses 22c, which correspond to the positions of the two cams 14 in the casing. These recesses can preferably be through slots, but it is also possible to use bottom grooves which have been machined from the outside of the box. The cams 14 will in this case cooperate with the edges of these recesses 22c for arresting the box to the casing when uninfluenced by outer forces, in conformity with the earlier described embodiments. In order not to weaken the bottom of the box unnecessarily it may be appropriate that the recesses 22c, and the cams 14 in the casing, are displaced laterally from each other, such as shown in FIG. 15.

Figure 16:
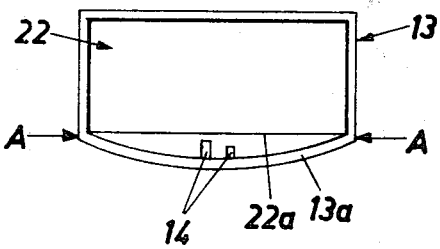
FIG. 16 is an end view of the container according to FIG. 14 showing the relative position of parts during its opening stage.

In FIG. 16 is finally shown in a schematic end view the container according to FIGS. 14 ad 15 during the opening stage, whereby in similarity with the embodiments according to FIGS. 1–10 the side walls of the casing are subjected to inward forces in the area of the casing wall 13a provided with the catch members 14, whereby said casing wall 13a will be bowed outward so that the catch members and their cooperating stop members will be disengaged.

It is preferable that the outer side of the casing is provided with a written instruction over the hand grip, which must be made for opening the container.

The cams 4, 14 can e.g. be fitted to the inner side of the casing by gluing, which can be easily done automatically during manufacture and the further work operations needed for this are of such a limited extent that it will not make the container appreciably more expensive as compared to a conventional container which is not child-proof.

The economical difference will be still less for the embodiment with tabs 5 as these can be easily punched out in an arbitrary position in the manufacturing machine.

The invention is not limited to the embodiments shown in the figures and described in connection thereto but the child-proof container according to the invention can be amended and modified in several manners within the scope of the appended claims. The members projecting from the casing can thus e.g. consist of metallic or plastic tabs, which are riveted to the upper wall of the casing, they can be hooks pinched to the casing or the like and it is also possible to manufacture the entire casing from a plastic material, whereby during manufacture it is provided with inward enbends by the shaping tool or by pressing.

The use of the child-proof container according to the invention is not limited to matches, but it can also be used for a number of after things, which are to be kept out of reach for children, e.g. different medicaments, needles etc.

I claim:

1. In a child-proof container of the type comprising a drawer which is slidably displaceable in a casing having at least one of its flat side walls made from a material which is flexible in the latitudinal direction and on the inside of said one flat side wall is provided with catch means extending therefrom towards the interior of the casing, the improvement wherein the casing comprises a tubular member which has a rectangular cross-section and is open a both ends, the catch means comprises at least two, spaced apart cam members located one near each one of the open ends of the casing and extending towards the interior thereof a distance exceeding the normal play between the casing and drawer, said cam members each having a substantially flat outer face inclined from said one flat side wall of said casing toward the adjacent open end and a substantially flat end face extending from and substantially perpendicular to said one flat side wall a distance sufficient to extend inside the edge of the adjacent end wall of the drawer when in the closed position thereby preventing unintentional opening of the container, and to release said edge to allow the drawer to be slidingly displaced to the open position by outward bending of said one flat side wall of the casing caused by forces acting toward said casing and substantially perpendicularly to the displacement direction of the drawer, the flat outer inclined face of the other cam member engaging said released edge to resist complete removal of said drawer from said casting.

2. A child-proof container according to claim 1, characterized thereby, that the catch members (4) of the casing (3) consist of cams fitted to the inner side of said one flat side wall (3a, 13a) of the casing and each one having an inclined surface (4a), which gives the cam diminishing height in a direction away from the associated casing short side.

3. A child-proof container according to claim 1, wherein said cam members of the casing comprise material tabs bent out of said one flat side wall of the casing towards the interior of the casing.

4. A child-proof container according to claim 1 wherein said drawer has an open upper side and said cam members are disposed on the inside of the upper side of said casing and extend into said drawer from the open upper side thereof.

5. A child proof container according to claim 1 wherein said cam members are disposed on the inside of the bottom side wall of the casing, and stop members are provided on the bottom side of said drawer.

6. A child-proof container according to claim 5, wherein said stop members comprise recesses in the bottom side of said drawer which interengage with said cam members.

7. A child-proof container according to claim 6, wherein said recesses are slots extending through the bottom of said drawer.

8. A child-proof container according to claim 5 wherein the bottom of the drawer is offset a distance above the lower edges of its end walls, and said lower edges of the end walls situated below said bottom comprise said stop members.

9. A child-proof container according to anyone of the preceding claims, wherein the longitudinal side walls of the casing slightly diverge in the direction toward the said one flat side wall provided with said cam members.

* * * * *